US005306865A

United States Patent [19]

Dinnan et al.

[11] Patent Number: 5,306,865

[45] Date of Patent: Apr. 26, 1994

[54] ELECTRONIC KEYBOARD MUSICAL INSTRUMENT OR TONE GENERATOR EMPLOYING MODIFIED EASTERN MUSIC TRU-SCALE OCTAVE TRANSFORMATION TO AVOID OVERTONE COLLISIONS

[75] Inventors: James A. Dinnan; Joseph A. Dinnan; Thomas P. Dinnan; James W. Dinnan, all of Athens, Ga.

[73] Assignee: Meta-C Corp., Athens, Ga.

[21] Appl. No.: 451,837

[22] Filed: Dec. 18, 1989

[51] Int. Cl.[5] ..... G10C 3/12

[52] U.S. Cl. ..... 84/622; 84/451

[58] Field of Search ..... 84/314 R, 428, 451, 84/646, 670, 722, 743, DIG. 30, 615, 622, 423

[56] References Cited

U.S. PATENT DOCUMENTS

| | | | |
|---|---|---|---|
| 835,580 | 11/1906 | Taylor | 84/451 |
| 904,325 | 6/1907 | Heffernan | 84/451 |
| 2,706,926 | 1/1953 | Young | 84/451 |
| 3,915,050 | 10/1975 | Hak | 84/175 |
| 3,939,751 | 2/1976 | Harasek | 84/721 |
| 4,132,143 | 1/1979 | Stone . | |
| 4,137,813 | 2/1979 | Stone et al. . | |
| 4,176,574 | 12/1979 | Nogimura | 84/DIG. 11 |
| 4,480,519 | 11/1984 | Allen | 84/423 A X |
| 4,635,517 | 1/1987 | Nagashima et al. | 84/619 |
| 4,681,007 | 7/1987 | Nikaido et al. | 84/626 |
| 4,700,604 | 10/1987 | Morikawa et al. | 84/DIG. 12 |
| 4,860,624 | 8/1989 | Dinnan et al. | 84/454 |

FOREIGN PATENT DOCUMENTS 2202985 8/1988 United Kingdom ..... 84/314 R

OTHER PUBLICATIONS

Musical Acoustics, McGraw-Hill Book Company Inc, Culver, 1956, pp. 141-145.

Modern Physics, Holt Rinehart and Winston Inc, Dull, 1960, pp. 291-292.

Fundamentals of Acoustics, John Wiley and Sons, Kinsler, 1982, pp. 36, 45-46.

"Exploring East Indian Microtonality", Wheat Williams III, pp. 46-54, Electronic Musician (Mar. 1989).

"The Problem of Continuity in Music and Sruti Studies in Indian Musical Scales", B. Chaitanya Deva, The Music of India: A Scientific Study, pp. 94-103.

"The Shared Tradition: Ensemble, Pitch, Notation, and Drone", Bonnie C. Wade, Music in India: The Classical Traditions, pp. 27-39.

*Primary Examiner*—William M. Shoop, Jr.
*Assistant Examiner*—Brian Sircus
*Attorney, Agent, or Firm*—Sughrue, Mion, Zinn, Macpeak & Seas

[57] ABSTRACT

An electronic musical instrument for reproducing chords or pure tones in a fixed interval scale, called Modified Eastern Music Tru-Scale Octave Transformation by the inventors, without overtone collision. The instrument includes a memory for storing and reproducing the 24 octave frequency interval system. The inventive instrument reproduces single or multiple notes with an interval system which eliminates dissonance, and allows complete modulation in all key signatures and pure tone relationships without altering the keyboard. The invention also contemplates the use of the Modified Eastern Music Tru-Scale frequencies with all MIDI interface compatible instruments or devices, in conjunction with a suitable frequency generator, or through internal or external memory sources. The invention also can be applied to a fretted stringed musical instrument which provides a novel fretboard for generating overtone collision-free tones with complete modulation of the Modified Eastern Music Tru-Scale Octave Transformation. Generation of these frequencies might be acoustical or "direct" (to an amplifier) electronic production. The string length, determined by a ratio, is calculated to produce a closed number relationships for independent time-space frequencies.

6 Claims, 3 Drawing Sheets

ELECTRONIC KEYBOARD MUSICAL INSTRUMENT OR TONE GENERATOR EMPLOYING MODIFIED EASTERN MUSIC TRU-SCALE OCTAVE TRANSFORMATION TO AVOID OVERTONE COLLISIONS

BACKGROUND OF THE INVENTION

This invention relates to providing a Tru-Scale Octave Transformation for the Eastern Musical System (24 frequency octave), which is contrasted with the Western Musical System (12 frequency octave) with overtone collision free tones produced by both electronic instruments and fixed fretted stringed instruments of the acoustic or electronic type, and is a follow-on to, and an improvement of an invention which is disclosed in commonly assigned U.S. Pat. No. 4,860,624, and of copending, commonly assigned U.S. application Ser. No. 07/404,385, filed Sep. 8, 1989. The disclosures of that U.S. Patent and that U.S. application are incorporated herein by reference.

As stated in the *New Harvard Dictionary of Music* (1986), p. 778, South Asia is centered on India, and includes countries on its periphery. The treatise deals with the Great Tradition of music (as opposed to the Little Tradition which is more localized):

> Among the aspects of musical theory described in the treatise (Natya Sastra, 5th century) is a tuning system of 22 intervals (Sruti) in the octave from which two heptatonic species of octave (grama) are derived. . . . After the 16th century, theoretical treatises reflect a split of the Great Tradition into two styles, now called Hindustani and Carnatic systems....The Carnatic approach emphasized a method of scale (mela) construction that would allow classification of the ragas according to their pitch content. All 72 scales possible in the 12 tone division of the octave. . .In Hindustani music, however, Bhatkhande devised a different scheme based on a group of 10 scales derived from fretting arrangements for the sitar (thata).

The Eastern music system has posed a mathematical question for which many solutions have been offered. Some say that 22 sruti-s and 7 notes are closely related to the ratio of the circumference and radius of a circle (22/7). Some are of the opinion that this is a small number which does not introduce *much error* when we change ratios into additive numbers!

U.S. Pat. No. 4,860,624 teaches that:

> Tru-Scale tuning involves new mathematic principles of a standard unit of measurement, related to a new measure of periodicity of wave transmission. When applied to the sound production components of an electronic instrument, primary or secondary, or other wave producing equipment, this tuning system can profoundly enhance the equipment's sound or performance. The enhancement is accomplished by eliminating the amount of dissonance caused by overtone collision by providing simultaneous frequencies with independent timespace relationships.

In the present production of electronic sound, a controlled electric impulse is sent to an oscillator, in which the impulse is turned into a specific assigned frequency. It is important to note that the initial impulse, which ultimately ends up as a predetermined frequency, is determined by mathematical computations using logarithms based on the present imperfect mathematical system. These various divisions of sound, such as Equal Temperament, Just Intonation, Meantone, and Pythagorean, represent many prior attempts to divide sound into a non-dissonate interval system. The present Eastern Music system (Sruti-Scales) is said by most scholars to be based on Just Intonation.

U.S. Pat. No. 4,860,624 teaches further:

> The Tru-Scale tuning system solves the problem of dissonance by using a new mathematical base. The new base incorporates the curve imposed by nature on all moving objects, including sound waves. Current mathematics, which is used in all prior tunings, is calculated on a two dimensional plane. Tru-Scale tuning is based on a three dimensional mathematical mode. (This system takes into account the natural curve of wave travel). Therefore, intervals between waves can be calculated to move in unison with no dissonance or overtone collision. This cannot be done with current mathematical theory due to improper calculations of wave movement. Such improper calculations yield harmonic dissonance. . .
>
> The overall effect of Tru-Scale tuning creates a much cleaner and stronger sounding interval system, which in turn creates better sounding chords. The mathematical foundation behind the Tru-Scale tuning can also be used to enhance all forms of wave production, transmission and reception.

With reference to the fretted stringed musical instrument, U.S. Pat. No. 4,132,143 teaches that:

> A fretted musical instrument employs one or more elements, termed frets, which function to shorten the length of a vibrating string by stopping at a precise point to thereby alter the pitch or frequency of the sound produced by the vibrating string. Fretted musical instruments may be generally divided into two categories: those having fixed frets and those having moveable frets.

Further U.S Pat. No. 4,137,813 teaches that:

> The location of frets on the fingerboard provides a fixed set of tones which can be generated on any one instrument. The available tones from such an instrument is called its tonal scale.

As disclosed in copending, commonly assigned application Ser. No. 07/404,385:

> Another novel feature of this invention is a difference in the standard straight fret placement for the 12 tone, Western Music, tonal scale for a six string guitar. For equal temperament, string length is 26.2 inches (U.S. Pat. No. 4,132,143), whereas for Tru-Scale the string length is 24 inches.

As previously noted, the string length of the Vina (Bin), Eastern Music's main melody instrument, is at present 22 inches long, with twenty-four fixed frets. This invention provides a novel Tru-Scale string length of 24 inches, but for a 24-note scale for Eastern music, as compared to a 12-note scale for Western music, as is the subject of the copending application.

SUMMARY OF THE INVENTION

In view of the foregoing, one of the objects of the present invention is to provide a novel and useful keyboard instrument with a retrievable system of stored frequencies within the 24 tone octave of the Modified Eastern Music Tru-Scale Octave Transformation, in which the above described advantages of overtone collision free notes will be provided for both drone and melody and relationships between frequencies. Further, these same 24 ratio calculations can be used to produce acoustic or electronic frequency or frequencies with stringed instruments of fixed or moveable frets. The transformation also may be applied to any tone generator which produces the Tru-Scale Octave Transformation 24 frequency series (low or high tone series).

The present invention accomplishes what previous efforts have failed to achieve. According to the invention, there is provided a system of notes, in an octave of 24 tones, allowing complete freedom of modulation and perfectly tuned interval chords (12.5 Hz for one of the octaves), using a stored memory computer source as a signal for predetermined assigned frequency or frequencies. The inventors call the novel interval the Modified Eastern Music Tru-Scale Octave Transformation. With this novel interval, all of the advantages of fixed-scale intervals, such as relative ease of transposition, are retained, while the disadvantages, such as more severe overtone collision, are eliminated.

Another important aspect of this invention is the retention of the availability of starting wherever one might choose, a treasured flexibility for Indian players, and using any of the overtone collision free intonations within the 24 tone Modified Eastern Music Tru-Scale Octave Transformation system (low, middle or high).

Also according to the invention, there is provided a series of frets on a fingerboard which, when struck, provides an octave (24 note) transformation called Modified Eastern Music Tru-Scale, which was previously applied to keyboard instruments, with a 12 note, Western Music octave, as disclosed in copending U.S. patent application Ser. No. 07/404,385.

Another novel feature of this invention is a difference in the standard straight fret placement for the 24 tone, Eastern Music, tonal scale for a four (Vina, Bin) or seven (Sitar) stringed instrument. The present Vina or Bin has a standard string length of 22 inches, whereas the Modified Eastern Music Tru-Scale string length is 24 inches. This length (24 inches) or multiples thereof is consistent with the interval size of the Modified Eastern Music Tru-Scale Octave Transformation, which provides whole or half number intervals which mathematically are capable of closing, rather than the fractional extension of Pi ($\pi$) used as the basis of the present 22 Sruti system, which is based on Just Intonation.

DETAILED DESCRIPTION OF A PREFERRED EMBODIMENT

Figure 1:
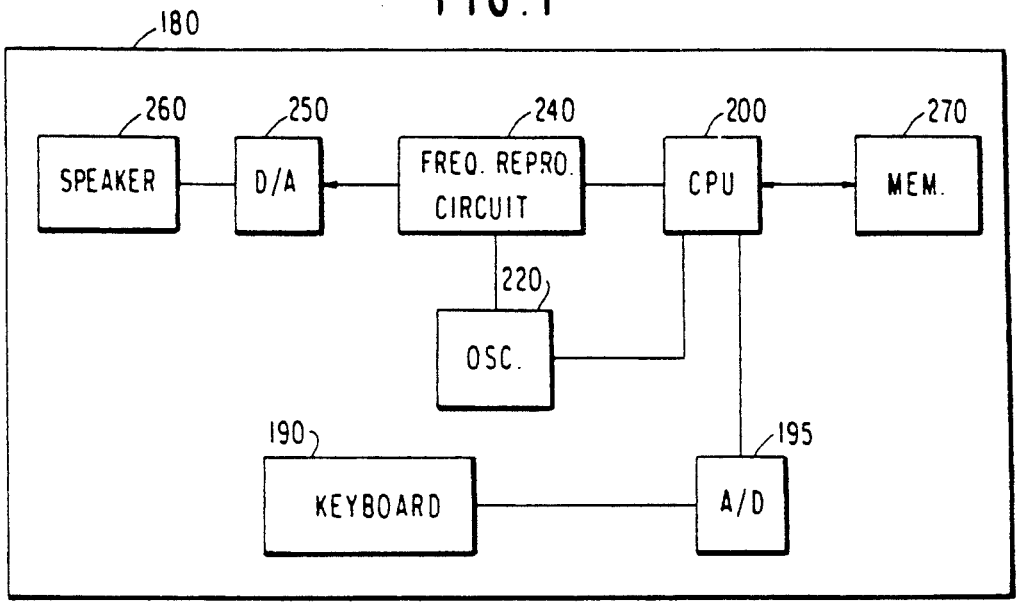
FIG. 1 is a block diagram of an electronic musical instrument according to the invention.

In FIG. 1, an electronic musical instrument according to the present invention includes a keyboard 190, which may contain any desired number of keys. Typically, such keyboards may enable selection of keys from as many as four different octaves, though some electronic keyboards have the full 88 keys. An analog-to-digital (A/D) converter 195 converts the keyboard input to digital form for input to a central processing unit (CPU) 200, which preferably is a microprocessor.

A memory 270 stores the Modified Eastern Music Tru-Scale frequency values which are output in accordance with particular keys being struck. When single keys are struck, the memory 270 provides a single value which is reproduced through the frequency reproduction circuitry 240, a digital-to-analog (A/D) converter 250, and a loudspeaker 260. For reproduction of struck chords, the memory 270 provides a value for each key being struck, and the CPU controls timing of output of sound as a single chord, though the memory 270 may output only one value at a time (such as a drone).

Figure 2:
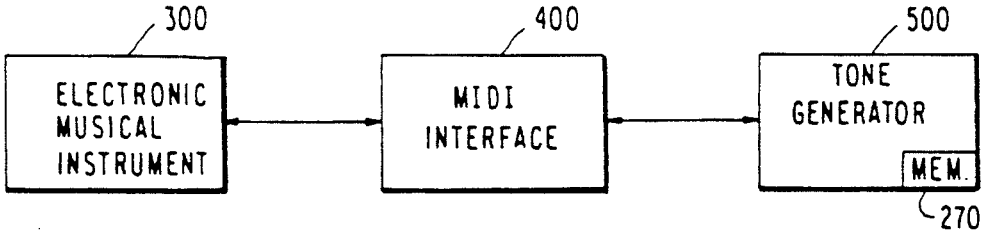
FIG. 2 is a block diagram of a tone generator according to the invention, connected through a suitable interface to an electronic musical instrument.

In FIG. 2, a programmable tone generator 500 contains a memory 270 of suitable construction, as is well known in the art, the memory 270 storing the Modified Eastern Music Tru-Scale Octave Transformation. The tone generator 500 is connected through a suitable interface 400, such a MIDI interface, to an electronic musical instrument 300, enabling the musical instrument to reproduce scales, drones, and melody frequencies using the Modified Eastern Tru-Scale Octave Transformation Interval system, even though the memory of the instrument 300 may not contain the "Tru-Scale" intonations. The MIDI interface is well known in the art; thus, a detailed description of the MIDI interface is not necessary here to a full appreciation of the invention.

Figure 3:
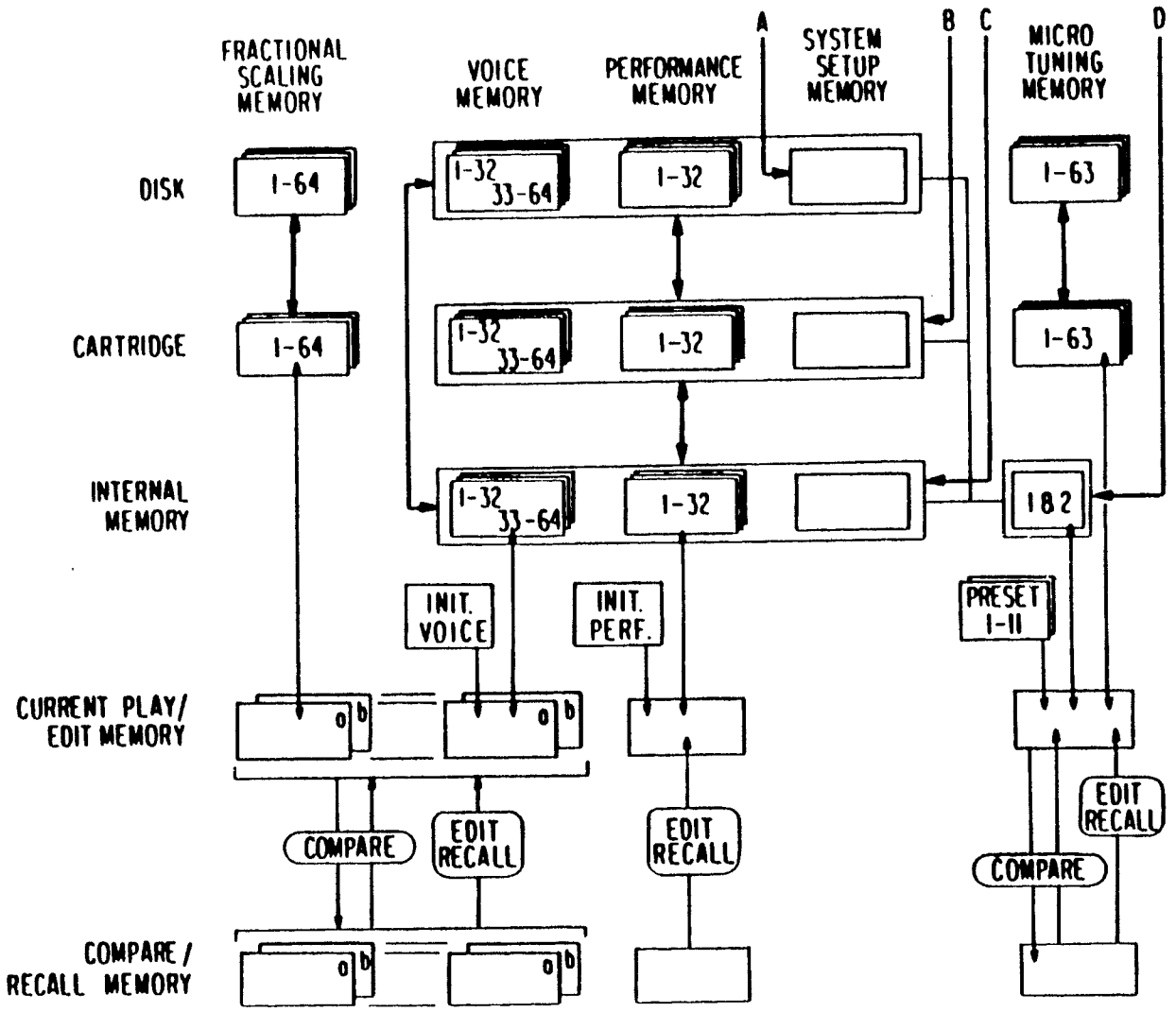
FIG. 3 is a block diagram showing the memory layout of a general construction of one embodiment of an electronic musical instrument to which the present invention may be applied.

FIG. 3 shows in block form an exemplary layout of the memory 270 for an electronic musical instrument, such as a synthesizer, according to the present invention. Synthesizers are used for reproducing many different types of sound known as voices, and so the memory 270 may contain data corresponding to various musical instruments, such as a piano, an organ, a sitar, a violin, a tambura, etc. When the keyboard 190 (FIG. 1) produces a pitch determining voltage signal and keying signal in response to depression of a selected key or keys, the CPU 200 instructs the retrieval of predetermined signals from the memory 270.

The memory 270 may have stored therein data for 64 voice memories, 32 performance memories plus one (A,B,C) system setup memory and two (D) user-defined micro tunings. The Modified Eastern Music Tru-Scale Octave Transformation sequence of frequencies is programmed into the internal memory system for retrieval as desired, thus avoiding the need for multi-scale devices to eliminate dissonance caused by overtone collisions or clashing frequencies.

The Modified Eastern Music Tru-Scale octave Transformation is a scale with tones of fixed pitch (24 octave notes), yielding perfectly tuned chords and notes allowing complete freedom of modulation. These frequency data can be used for basic MIDI settings on all other instruments calling for reception, storing, or transmission of the Modified Eastern Music using Tru-Scale frequencies, as alluded to above with reference to FIG. 2. Further, these data may be stored for use as a dependent or independent computer source on optical or magnetic disks, in cartridges, or in semiconductor form (RAM or ROM). Data storage in memories is well known in the art, and details of implementation are not necessary here to a full appreciation of the invention.

Figures 4A, 4B:
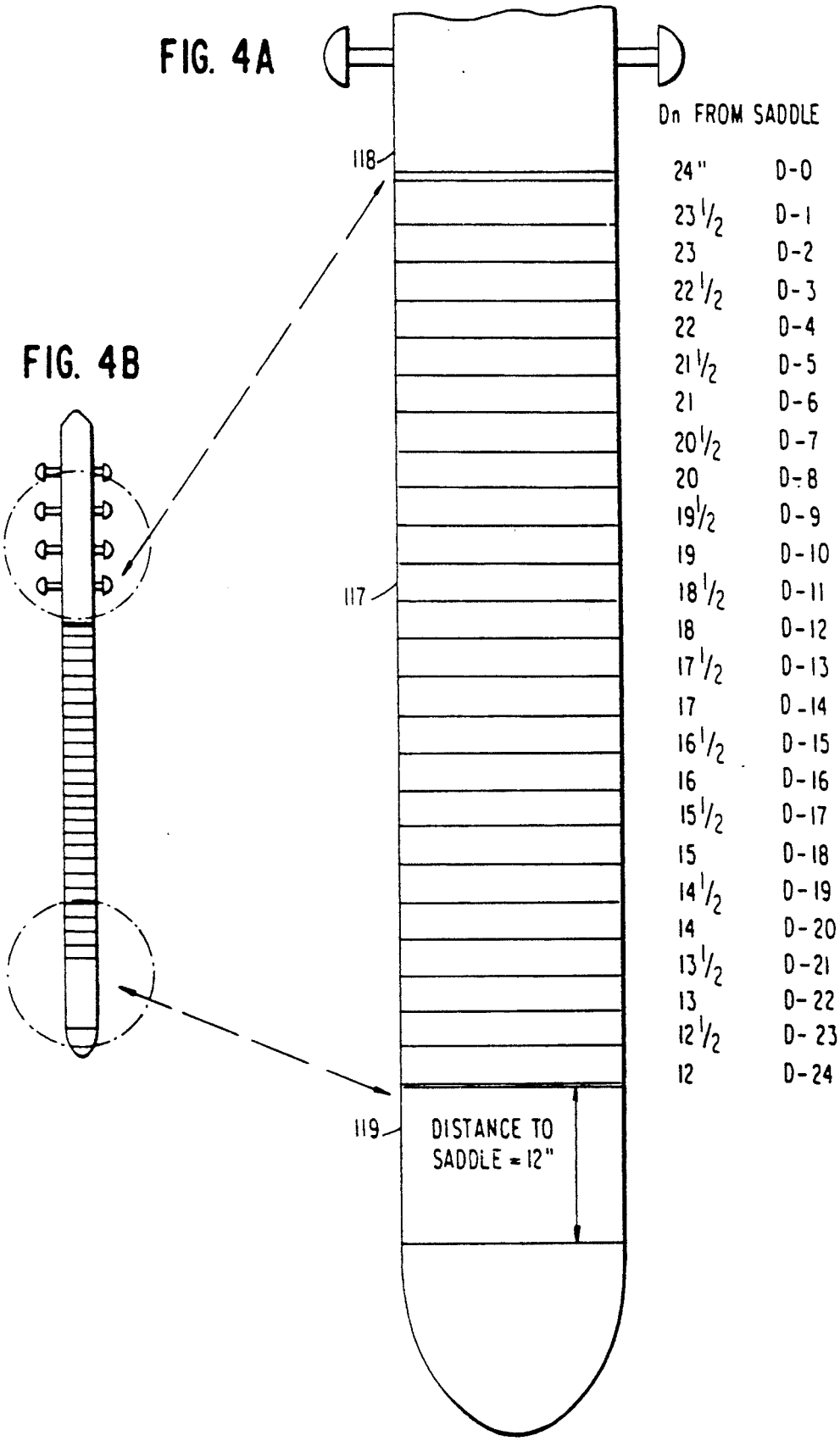
FIG. 4A and 4B are drawings of a fixed fretted instrument, acoustic or electronic, according to the present invention.

In FIG. 4, an acoustical instrument according to the invention includes a fixed, straight, permanent fret board (117) which measures 24 (a distance L) from Nut 118 to Saddle 119. The distance for each fret (Dn) is indicated by D-(1-24). These novel fret stops, in conjunction with open strings which have been tuned correctly, will produce the Modified Eastern Music Tru-Scale Octave Transformation. Without precise placement of the frets, no other present state of the art fret boards could produce these overtone collision free tones of the disclosed Octave Transformation.

Figure 5:
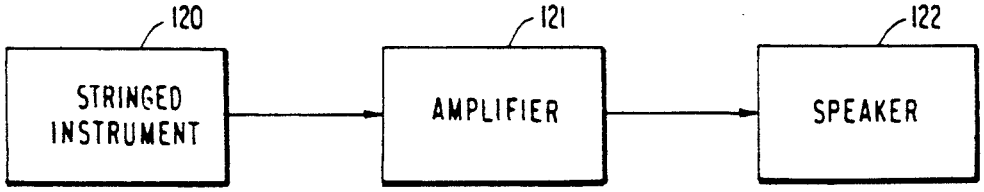
FIG. 5 is a block diagram in which the fixed fretted instrument of FIG. 4 is employed in conjunction with an amplifier.

FIG. 5 shows, in block diagram form, a stringed fretted instrument with precise Modified Eastern Music Tru-Scale fret dimensions 120 connected to a standard electronic amplifier 121 which in turn is connected to a speaker or speakers 122 for the production of sound or sounds which are the direct result of the calculated inventive Modified Eastern Music Tru-Scale Octave Transformation's fret placement. These frequencies are produced by direct pressure applied to the inventive fret placement and do not rely upon any stored electronic memory unit or units.

Table I shows the present system of an Eastern Music Scale. The ratios, notes, frequency and intervals between notes are recorded. An apparent inconsistency in the present system in regard to $A\#^1$ and $B^1$ (a repeated measure using the same frequency three times to make up the distance to $C^2$) has been considered acceptable because of the 22/7 Pi ($\pi$) tradition that has developed in Eastern Music, resulting in a 22 interval system. Further, the fractional extension of the frequencies, which will never close to whole numbers, is a result of the mathematical system used to measure wave transmission based upon the standard error of the mean and all its inherent inconsistencies.

Table II, titled "Modified Eastern Music Tru-Scale Octave Transformation" shows an octave transformation utilizing twenty-four equally divided frequencies culminating in a 2:1 ratio. The interval is a consistent 12.5, and the frequencies, which are whole or half numbers, when extended will close or will have closed in the octave. While only a few scales are shown, the pattern for continuing the octave transformation (towards a higher or lower set of frequencies) may be seen radially and suggest applicability of the Modified Eastern Music Tru-Scale system to elimination of overtone collision, interference, etc. in any range of frequencies. In contrast to the present Eastern Music Systems (Sruti, or Thata), the novel Modified Eastern Music Tru-Scale Octave Transformation's separation provides a system of time-space relationships that allows a frequency to be used with other frequencies, which are compatible, and thus avoids the dissonance caused by all other interval systems.

TABLE 1

| | EASTERN RAGAS | | |
|---|---|---|---|
| RATIOS | NOTE | FREQUENCY | INTERVAL |
| 1:1 | $C^0$ | 174.61* | |
| | | | 9.43 |
| 256:243 | C# | 183.95 | |
| | | | 2.3 |
| 16:15 | D | 186.25 | |
| | | | 7.76 |
| 10:9 | D# | 194.01 | |
| | | | 2.42 |
| 9:8 | E | 196.43 | |
| | | | 10.51 |
| 32:27 | F | 206.94 | |
| | | | 2.59 |

TABLE 1-continued

| | EASTERN RAGAS | | |
|---|---|---|---|
| RATIOS | NOTE | FREQUENCY | INTERVAL |
| 6:5 | F# | 209.53 | |
| | | | 8.67 |
| 5:4 | G | 218.26 | |
| | | | 2.73 |
| 81:64 | G# | 220.99 | |
| | | | 11.82 |
| 4:3 | A | 232.81 | |
| | | | 2.91 |
| 27:20 | A# | 235.72 | |
| | | | 9.82 |
| 45:32 | B | 245.54 | |
| | | | 2.79 |
| 64:45 | $C^1$ | 248.33 | |
| | | | 13.58 |
| 3:2 | $C\#^1$ | 261.91 | |
| | | | 14.01 |
| 128:81 | $D^1$ | 275.92 | |
| | | | 3.45 |
| 8:5 | $D\#^1$ | 279.37 | |
| | | | 11.64 |
| 5:3 | $E^1$ | 291.01 | |
| | | | 3.64 |
| 27:16 | $F^1$ | 294.65 | |
| | | | 15.76 |
| 16:9 | $F\#^1$ | 310.41 | |
| | | | 3.88 |
| 9:5 | $G^1$ | 314.29 | |
| | | | 13.1 |
| 15:8 | $G\#^1$ | 327.39 | |
| | | | 4.09 |
| 243:128 | $A^1$ | 331.48 | |
| | | | 0 |
| (243:128) | $A\#^1$ | (331.48) | |
| | | | 0 |
| (243:128) | $B^1$ | (331.48) | |
| | | | 17.74 |
| 2:1 | $C^2$ | 349.22 | |

*The frequency of $C^0$ was calculated from an equal-tempered F starting point by the author. Wheat William, III. "Exploring East Indian Microtonality" Electronic Musician. March, 1989.

TABLE II

| | MODIFIED EASTERN MUSIC TRU-SCALE OCTAVE TRANSFORMATION | | |
|---|---|---|---|
| RATIOS | NOTE | FREQUENCY | INTERVAL |
| 1:1 | $C^0$ | 300 | |
| | | | 12.5 |
| 25:24 | C# | 312.5 | |
| | | | 12.5 |
| 13:12 | D♭ | 325 | |
| | | | 12.5 |
| 9:8 | D | 337.5 | |
| | | | 12.5 |
| 7:6 | D# | 350 | |
| | | | 12.5 |
| 29:24 | E♭ | 362.5 | |
| | | | 12.5 |
| 5:4 | E | 375 | |
| | | | 12.5 |
| 31:24 | E# | 387.5 | |
| | | | 12.5 |
| 4:3 | F♭ | 400 | |
| | | | 12.5 |
| 11:8 | F | 412.5 | |
| | | | 12.5 |
| 17:12 | F# | 425 | |
| | | | 12.5 |
| 35:24 | G♭ | 437.5 | |
| | | | 12.5 |
| 3:2 | G | 450 | |
| | | | 12.5 |
| 37:24 | G# | 462.5 | |
| | | | 12.5 |
| 19:12 | H♭ | 475 | |
| | | | 12.5 |
| 13:8 | H | 487.5 | |
| | | | 12.5 |

TABLE II-continued

MODIFIED EASTERN MUSIC TRU-SCALE OCTAVE TRANSFORMATION

| RATIOS | NOTE | FREQUENCY | INTERVAL |
|---|---|---|---|
| 5:3 | H# | 500 | |
| | | | 12.5 |
| 41:24 | A♭ | 512.5 | |
| | | | 12.5 |
| 7:4 | A | 525 | |
| | | | 12.5 |
| 43:24 | A# | 537.5 | |
| | | | 12.5 |
| 11:6 | B♭ | 550 | |
| | | | 12.5 |
| 15:8 | B | 562.5 | |
| | | | 12.5 |
| 23:12 | B# | 575 | |
| | | | 12.5 |
| 47:24 | C♭ | 587.5 | |
| | | | 12.5 |
| 2:1 | C[1] | 600 | |

*Modified by adding two frequency notes (making 24 instead of 22 notes in the octave) a logical development of an overtone collision free octave of twenty-four equally divided ratios using all of the prime numbers that exist in the first 50 numbers.

Table III, entitled "Modified Eastern Music Tru-Scale for Stringed Instruments Fixed Frets", is a listing of the twenty-four (24) fixed fret placements which give the distance in inches from the nut to the saddle in a stringed instrument for playing Eastern music, the intervals between each successive fret bar, and the ratio for each fret. While the Vina and Bin have been cited as an example of a stringed instrument, multiples of the distance might be used with any stringed instrument which would be apparent to any artist familiar with the art of Eastern Music.

TABLE III

MODIFIED EASTERN MUSIC TRU-SCALE MEASUREMENTS FOR STRINGED INSTRUMENTS FIXED FRETS

| Fret to Saddle in Inches | | Interval | Ratio |
|---|---|---|---|
| 0 Nut | 24" | | 1:1 |
| | | 1/2" | |
| 1 | 23½ | | 25:24 |
| | | 1/2" | |
| 2 | 23 | | 13:12 |
| | | 1/2" | |
| 3 | 22½ | | 9:8 |
| | | 1/2" | |
| 4 | 22 | | 7:6 |
| | | 1/2" | |
| 5 | 21½ | | 29:24 |
| | | 1/2" | |
| 6 | 21 | | 5:4 |
| | | 1/2" | |
| 7 | 20½ | | 31:24 |
| | | 1/2" | |
| 8 | 20 | | 4:3 |
| | | 1/2" | |
| 9 | 19½ | | 11:8 |
| | | 1/2" | |
| 10 | 19 | | 17:12 |
| | | 1/2" | |
| 11 | 18½ | | 35:24 |
| | | 1/2" | |
| 12 | 18 | | 3:2 |
| | | 1/2" | |
| 13 | 17½ | | 37:24 |
| | | 1/2" | |
| 14 | 17 | | 19:12 |
| | | 1/2" | |
| 15 | 16½ | | 13:8 |
| | | 1/2" | |
| 16 | 16 | | 5:3 |
| | | 1/2" | |
| 17 | 15½ | | 41:24 |
| | | 1/2" | |
| 18 | 15 | | 7:4 |
| | | 1/2" | |
| 19 | 14½ | | 43:24 |
| | | 1/2" | |
| 20 | 14 | | 11:6 |
| | | 1/2" | |
| 21 | 13½ | | 15:8 |
| | | 1/2" | |
| 22 | 13 | | 23:12 |
| | | 1/2" | |
| 23 | 12½ | | 47:24 |
| | | 1/2" | |
| 24 | 12 | | 2:1 |

Distance to Saddle = 12 inches

While the foregoing has been provided with reference to a preferred embodiment, various changes will be apparent to those of working skill in this technical field. Thus, the invention is to be considered as limited only by the scope of the appended claims.

What is claimed is:

1. In an electronic musical instrument for playing Eastern music in accordance with Eastern tonalities, comprising:

a keyboard, including a plurality of keys which may be depressed singly or in combination; and means for reproducing said Eastern tonalities in accordance with ones of said keys being depressed singly or in combination, wherein depression of combinations of said keys normally results in overtone collision;

the improvement wherein said reproducing means includes means for eliminating said overtone collision when said ones of said keys are depressed in combinations, said overtone collision eliminating means comprising means for reproducing musical notes in accordance with a 24-tone fixed interval scale system for reproducing said Eastern tonalities;

wherein said means for eliminating said overtone collision comprises means for reproducing notes of a musical scale in accordance with the following octave transformation:

| RATIOS | NOTE | FREQUENCY | INTERVAL |
|---|---|---|---|
| 1:1 | C[0] | 300 | 12.5 |
| 25:24 | C# | 312.5 | 12.5 |
| 13:12 | D♭ | 325 | 12.5 |
| 9:8 | D | 337.5 | 12.5 |
| 7:6 | D# | 350 | 12.5 |
| 29:24 | E♭ | 362.5 | 12.5 |
| 5:4 | E | 375 | 12.5 |
| 31:24 | E# | 387.5 | 12.5 |
| 4:3 | F♭ | 400 | 12.5 |
| 11:8 | F | 412.5 | 12.5 |
| 17:12 | F# | 425 | 12.5 |
| 35:24 | G♭ | 437.5 | 12.5 |
| 3:2 | G | 450 | 12.5 |
| 37:24 | G# | 462.5 | 12.5 |
| 19:12 | H♭ | 475 | 12.5 |
| 13:8 | H | 487.5 | 12.5 |
| 5:3 | H# | 500 | 12.5 |
| 41:24 | A♭ | 512.5 | 12.5 |
| 7:4 | A | 525 | 12.5 |
| 43:24 | A# | 537.5 | 12.5 |
| 11:6 | B♭ | 550 | 12.5 |
| 15:8 | B | 562.5 | 12.5 |
| 23:12 | B# | 575 | 12.5 |
| 47:24 | C♭ | 587.5 | 12.5 |

-continued

| RATIOS | NOTE | FREQUENCY | INTERVAL |
|---|---|---|---|
| 2:1 | $C^1$ | 600. | |

2. An electronic musical instrument according to claim 1, wherein said overtone collision elimination means includes memory means for storing said fixed scale interval system as an octave transformation.

3. An electronic musical instrument according to claim 2, wherein said memory means comprises a flexible disk memory in which flexible disks may be inserted and removed.

4. An electronic musical instrument according to claim 2, wherein said memory means comprises a semiconductor random access memory.

5. An electronic musical instrument according to claim 2, wherein said memory means comprises an optical disk read-only memory.

6. In an electronic tone frequency generator comprising:

Interface means for connecting said electronic tone frequency generator to an electronic instrument such that said electronic tone generator is capable of receiving signals indicative of requested frequencies; and means for reproducing said requested frequencies in accordance with said signals, wherein an electronic musical instrument normally reproduces musical notes in combination such that overtone collision results:

the improvement wherein said reproducing means comprises means for eliminating said overtone collision, said overtone collision eliminating means comprising in turn means for reproducing Eastern tonalities in accordance with a 24-tone fixed interval scale.

wherein said means for eliminating said overtone collision comprises means for reproducing notes of a musical scale in accordance with the following octave transformation:

| RATIOS | NOTE | FREQUENCY | INTERVAL |
|---|---|---|---|
| 1:1 | $C^0$ | 300 | 12.5 |
| 25:24 | C♯ | 312.5 | 12.5 |
| 13:12 | D♭ | 325 | 12.5 |
| 9:8 | D | 337.5 | 12.5 |
| 7·6 | D♯ | 350 | 12.5 |
| 29:24 | E♭ | 362.5 | 12.5 |
| 5:4 | E | 375 | 12.5 |
| 31:24 | E♯ | 387.5 | 12.5 |
| 4:3 | F♭ | 400 | 12.5 |
| 11:8 | F | 412.5 | 12.5 |
| 17:12 | F♯ | 425 | 12.5 |
| 35:24 | G♭ | 437.5 | 12.5 |
| 3:2 | G | 450 | 12.5 |
| 37:24 | G♯ | 462.5 | 12.5 |
| 19:12 | H♭ | 475 | 12.5 |
| 13:8 | H | 487.5 | 12.5 |
| 5:3 | H♯ | 500 | 12.5 |
| 41:24 | A♭ | 512.5 | 12.5 |
| 7:4 | A | 525 | 12.5 |
| 43:24 | A♯ | 537.5 | 12.5 |
| 11:6 | B♭ | 550 | 12.5 |
| 15:8 | B | 562.5 | 12.5 |
| 23:12 | B♯ | 575 | 12.5 |
| 47:24 | C♭ | 587.5 | 12.5 |
| 2:1 | $C^1$ | 600. | |

* * * * *